US012110767B2

(12) United States Patent
Cho

(10) Patent No.: US 12,110,767 B2
(45) Date of Patent: Oct. 8, 2024

(54) DRILL DEVICE

(71) Applicant: YE SUNG OCEAN TECH., LTD, Seongnam-si (KR)

(72) Inventor: Beong Ho Cho, Seongnam-si (KR)

(73) Assignee: YE SUNG OCEAN TECH., LTD, Seongnam-si (KR)

( * ) Notice: Subject to any disclaimer, the term of this patent is extended or adjusted under 35 U.S.C. 154(b) by 128 days.

(21) Appl. No.: 17/623,846

(22) PCT Filed: Jun. 12, 2020

(86) PCT No.: PCT/KR2020/007651
§ 371 (c)(1),
(2) Date: Dec. 29, 2021

(87) PCT Pub. No.: WO2021/002607
PCT Pub. Date: Jan. 7, 2021

(65) Prior Publication Data

US 2022/0356787 A1 Nov. 10, 2022

(30) Foreign Application Priority Data

Jul. 2, 2019 (KR) ..... 10-2019-0079627

(51) Int. Cl.
*B63B 21/26* (2006.01)
*B63B 21/50* (2006.01)
*E21B 41/00* (2006.01)

(52) U.S. Cl.
CPC ..... *E21B 41/0007* (2013.01); *B63B 21/26* (2013.01); *B63B 21/502* (2013.01)

(58) Field of Classification Search
CPC ..... B63B 21/24; B63B 21/243; B63B 21/26; B63B 21/50; B63B 2021/505
USPC ..... 114/293, 294, 295, 297
See application file for complete search history.

(56) References Cited

U.S. PATENT DOCUMENTS 631,168 A * 8/1899 Langston
3,745,774 A * 7/1973 Sharp, Jr. ..... B63B 21/26 114/295
3,753,471 A * 8/1973 Kammerer, Jr. ..... F16D 1/10 175/320

(Continued)

FOREIGN PATENT DOCUMENTS

CN 104674803 A 6/2015
CN 109641639 A 4/2019

(Continued)

*Primary Examiner* — Sunil Singh
(74) *Attorney, Agent, or Firm* — Maschoff Brennan

(57) ABSTRACT

A drill device comprising: a pile configured such that same descends to a seafloor surface through a mooring installation device provided in a ship, and a part of the body thereof is fixed in an area of the seafloor surface as the upper surface thereof is pressurized in the vertical direction; a driving pipe configured such that same descends to the seafloor surface through a through-hole formed in the pile, the body thereof is inserted into a seafloor foundation, and same is recovered through the through-hole after excavation is completed; a chain, one end of which is fixed to one side of the pile, and the other end of which is introduced through the through-hole such that same is inserted into the seafloor foundation together with the driving pipe; and a drill bit unit.

3 Claims, 5 Drawing Sheets

(56) References Cited

U.S. PATENT DOCUMENTS

| | | | |
|---|---|---|---|
| 6,536,993 | B2 | 3/2003 | Strong et al. |
| 6,598,555 | B1 | 7/2003 | Bruce |
| 11,001,344 | B2 | 5/2021 | Cho |

FOREIGN PATENT DOCUMENTS

| | | | | |
|---|---|---|---|---|
| FR | 1548477 | A | * | 12/1968 |
| GB | 2340099 | | * | 2/2000 |
| JP | S53-80707 | A | | 7/1978 |
| JP | S53-105012 | A | | 9/1978 |
| JP | 61-206735 | U | | 12/1986 |
| JP | 2009-167685 | A | | 7/2009 |
| JP | 2011-079925 | A | | 4/2011 |
| JP | 2019-044479 | A | | 3/2019 |
| KR | 10-2016-0059007 | A | | 1/2017 |
| KR | 10-2018-0012612 | A | | 5/2018 |
| KR | 10-1859610 | B1 | | 12/2020 |
| WO | 01/88279 | A1 | | 11/2001 |
| WO | 2018/021807 | A1 | | 2/2018 |

* cited by examiner

[FIG. 1]
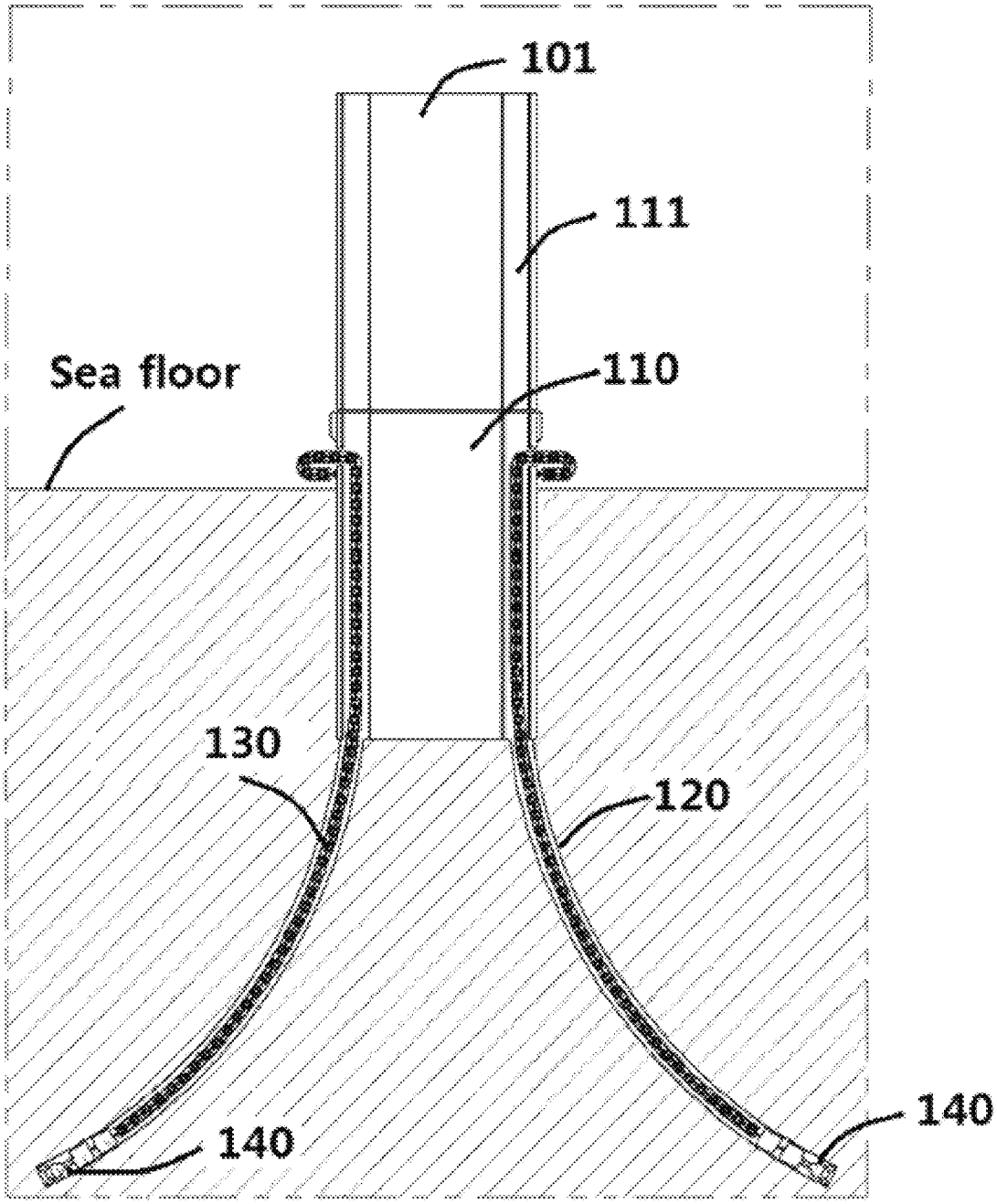

[FIG. 2]
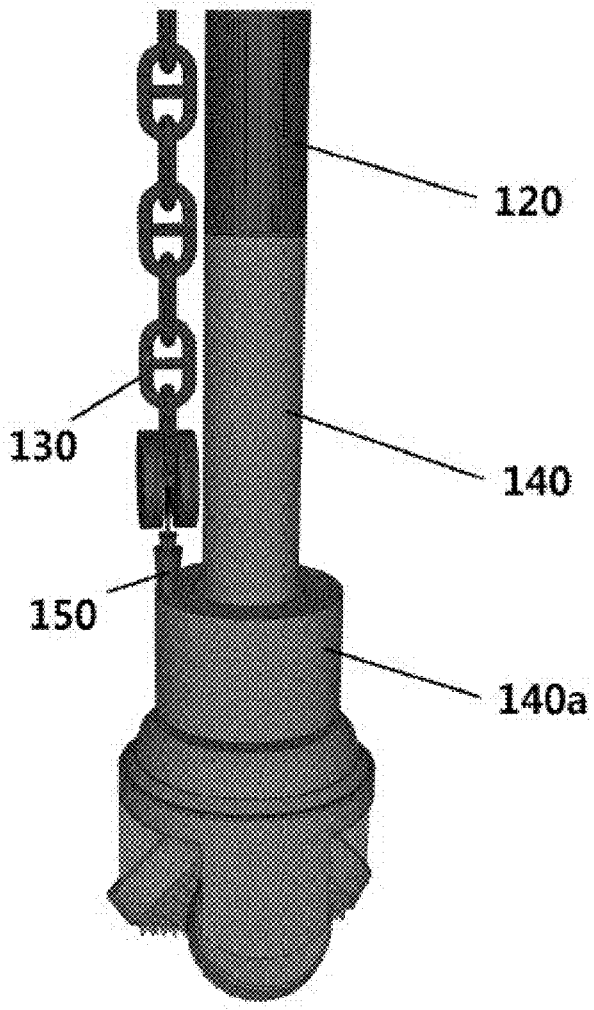

[FIG. 3]
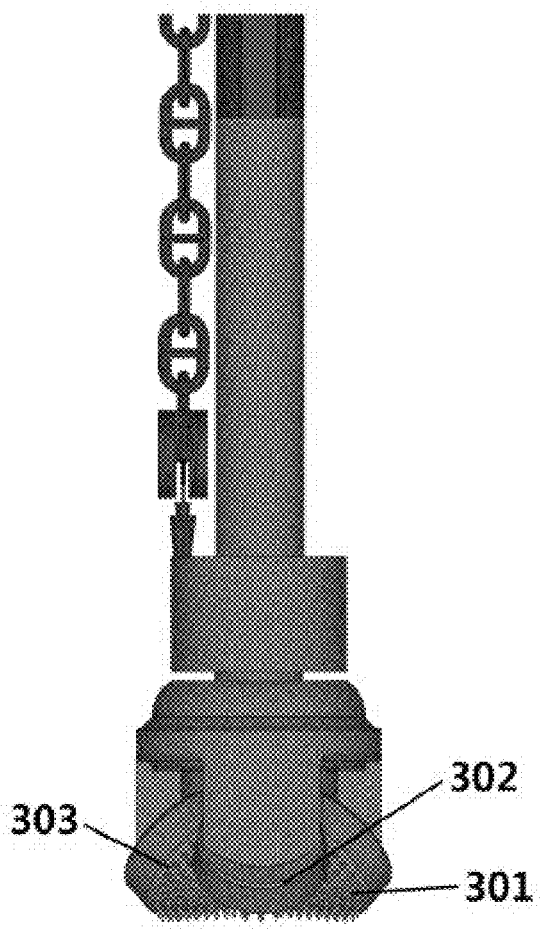

[FIG. 4]
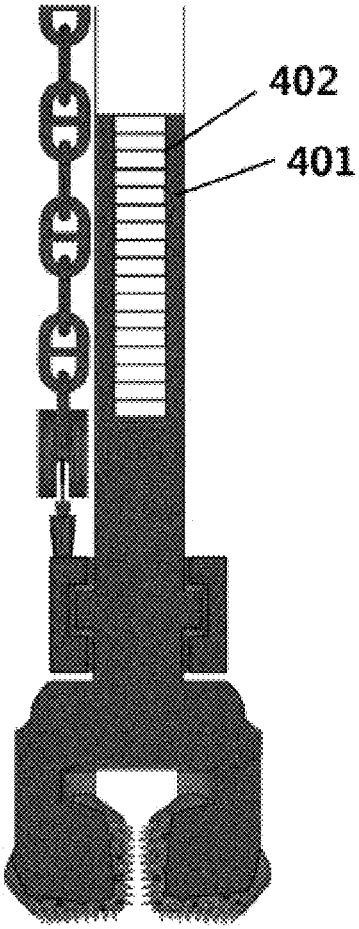

[FIG. 5]
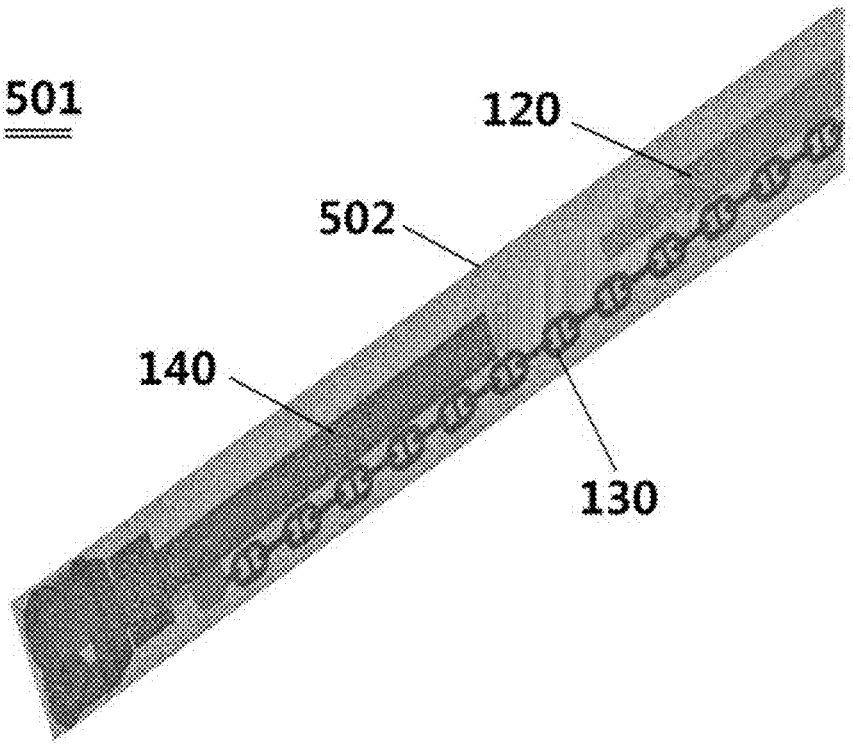
[FIG. 6]
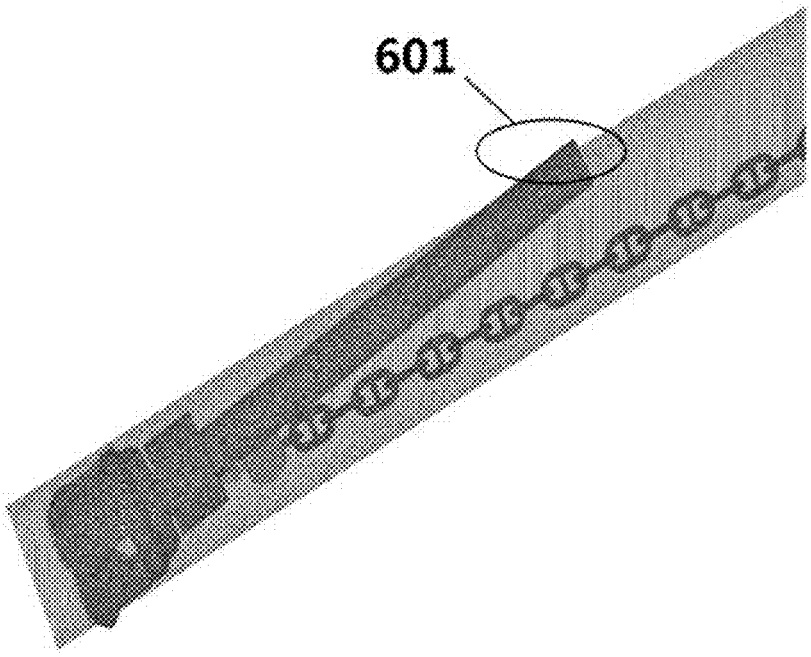

DRILL DEVICE

FIELD OF INVENTION

The present disclosure relates to a drill device for excavating a sea bed to install a mooring device fixed to a sea bed of the sea.

BACKGROUND OF INVENTION

In general, a mooring device for mooring a sea structure in the sea uses a mooring method for installing an anchor on a sea floor, a mooring method for installing a driven pile, and a tension leg platform (TLP) method.

These mooring devices are connected to the sea structure through a chain for mooring and support buoyancy of the sea structure due to waves. Thus, the mooring devices installed on the sea floor need to be strong and fixed to withstand typhoons and large waves.

Korean Patent No. 10-1859610 (Title of Invention: Mooring Device) discloses technology for fixing a pile by excavating a sea bed using a drill bit and inserting a chain into the sea bed in order to simply fix the pile. However, the technology has a problem in that the chain connected to the drill bit is wound around a driving pipe connection to a rear part of the drill bit to hinder excavation when the sea bed is excavated while the drill bit rotates.

SUMMARY OF INVENTION

Technical Problem to be Solved

The present disclosure provides a drill device for excavating a sea bed to install a mooring device fixed to a sea bed of the sea.

Technical Solution

Therefore, a first aspect of the present disclosure provides a drill device including a pile having a body part that is fixed to one region of the sea floor while the pile is lowered to a sea floor through a mooring construction device installed in a ship and an upper surface of the pile is pressurized in a vertical direction, a driving pipe that is lowered to the sea floor via a through hole formed in the pile, a body of which is inserted into a sea bed, and which is recovered through the through hole when excavation is completed, a chain having one end fixed to one side of the pile and another end input through the through hole to be inserted into the sea bed with the driving pipe, and a drill bit part including a drill bit installed on a front part of a body, and configured to insert the driving pipe and the chain into the sea bed in a state in which one end of the driving pipe is coupled to a coupler formed on a rear part of the body and another end of the chain is connected to a bearing surrounding the body.

A second aspect of the present disclosure provides a drill device including a driving pipe that is connected to a mooring construction device and is lowered to a sea floor, a body of which is inserted into the sea floor as the sea floor excavated, and which is recovered to a ship when excavation is completed, a chain inserted into the sea floor with the driving pipe, and a drill bit part including a drill bit installed on a front part of a body, and configured to insert the driving pipe and the chain into the sea bed by excavating the sea floor in a state in which the driving pipe is coupled to a coupler formed on a rear part of the body and the chain is connected to a bearing surrounding the body.

Effect of Invention

Embodiments of the present disclosure may have an effect including the following advantages. However, this does not mean that the embodiments of the present disclosure need to include all of them, and thus the scope of the present disclosure need not be construed as being limited thereby.

According to an embodiment of the present disclosure, a drill device may prevent a chain from being wound around a driving pipe when a drill bit part excavates a sea bed.

In addition, the sea bed may be radially excavated to increase fixing force of a chain.

After the driving pipe is recovered, the drill bit part may be fixed to an inner wall of the excavated sea bed to firmly maintain a fixed state of a pile.

BRIEF DESCRIPTION OF DRAWINGS

FIG. 1 is a side view of an entire drill device according to an embodiment of the present disclosure.

FIG. 2 is a perspective view of a drill device according to an embodiment of the present disclosure.

FIG. 3 is a side view of a drill bit according to an embodiment of the present disclosure.

FIG. 4 is a side view showing a connection structure of a drill bit part and a driving pipe.

FIG. 5 is a diagram showing the case in which a driving pipe coupled to a drill bit part is recovered.

FIG. 6 is a diagram showing the case in which a drill bit part is to an inner wall of a sea bed.

BEST MODE

Exemplary embodiments of the present disclosure can be variously changed and embodied in various forms, in which illustrative embodiments of the present disclosure are shown. However, exemplary embodiments of the present disclosure should not be construed as being limited to the embodiments set forth herein and any changes, equivalents or alternatives which are within the spirit and scope of the present disclosure should be understood as falling within the scope of the present disclosure.

The terms such as "first", "second", "A", and "B" are used herein merely to describe a variety of constituent elements, but the constituent elements are not limited by the terms. The terms are used only for the purpose of distinguishing one constituent element from another constituent element. For example, a first element may be termed a second element and a second element may be termed a first element without departing from the teachings of the present disclosure. The term "and/or" includes any and all combinations of one or more of the associated listed items The terms of a singular form may include plural forms unless otherwise specified. The terms such as "comprising" mean that the specified feature, number, step, operation, component, part, or a combination thereof exists, but do not exclude the possibility of the possibility of the presence or addition of one or more other features or number, step, operation, component, part, or a combination thereof.

Prior to a detailed description of the drawings, it is intended to clarify that classification of components in the present specification is merely a division for each main function of each component. That is, two or more components to be described below may be combined into one component, or one component may be divided into two or more for each more subdivided function.

Needless to say, each of the components to be described may additionally perform some or all of the functions of the other components in addition to the main function of the components, and some of the main functions of each component are dedicated by the other components may be performed. Accordingly, existence or non-existence of each component described through the specification needs to be interpreted functionally.

FIG. 1 is a side view of an entire drill device according to an embodiment the present disclosure. FIG. 2 is a perspective view of a drill device according to an embodiment of the present disclosure. Referring to FIGS. 1 and 2, the drill device may include a pile 110, a driving pipe 120, a chain 130, and a drill bit part 140. The drill device may further include a swivel 150.

The pile 110 may be a part of a mooring device connected to a sea structure through a chain and may be connected to a crane equipped on a ship. The sea structure may include a floating wind turbine. The ship may fix the pile 110 functioning as a mooring support of a sea structure to a sea bed and may fix the pile 110 to a sea floor using a method of accommodating the pile 110 at one point of the sea floor using a crane, lowering a housing 101 to the sea floor, and applying pressure to an upper surface of the pile 110. The housing 101 may be transported with a body thereof connected to a gantry crane and may be vertically lowered through a wire of the crane when descending. In this case, the pile 110, which is previously lowered, is placed at a bottom in a vertical direction.

A lower surface of a body of the pile 110 lowered undersea may be fixed to the sea floor as the upper surface of the pile 110 is pressurized in a vertical direction the housing 101. That is, a part of the body may be embedded in the sea bed to a predetermined depth from the sea floor and fixed to the sea bed. The weight of the housing 101 is equal to or greater than dozens of tons, and thus the pile 110 may be embedded in the soft sea bed to some extent due to pressure transmitted from the housing 101.

The pile 110 may be connected to the sea structure and may have a shape such as a kind of stack installed on the sea floor to fix the sea structure to the sea. For example, the pile 110 may use a driven pile that is lowered undersea through a wire included in the crane.

The driving pipe 120 may be lowered to the sea floor through a through hole 111 formed in the pile 110 and the housing 101. A plurality of through holes 111 may be formed in the pile 110 and the housing 101, and the driving pipe 120 may be lowered in the state of being inserted into the through hole 111 in order to insert the driving pipe 120 into the sea bed below the sea floor in the state which the sea floor is fixed. That is, in this state, when the driving pipe 120 is fixed to the sea floor, the drill bit part 140 connected to the driving pipe 120 may excavate the sea floor in contact with the drill bit part 140 and may dig into the sea bed, and the driving pipe 120 may be inserted into the sea bed.

When one driving pipe 120 is used, only one through hole 111 may be formed, and when the plurality of driving pipes 120 are used, the plurality of through holes 111 may be formed. Depending on a situation or an environment in which the driving pipe 120 is inserted, the through holes 111 may be perpendicularly formed to the sea floor or may be radially formed. For example, when the drill bit part 140 is connected to one driving pipe 120, the through holes 111 may be vertically formed or may be obliquely formed. When the drill bit part 140 is connected and fixed to each of the plurality of driving pipes 120, the through holes 111 may also be radially formed in order to radially insert each driving pipe 120 into the sea floor.

The driving pipe 120 may be recovered to the through hole 111 when excavation is completed. According to an embodiment, when excavation proceeds in the state in which the driving pipe 120 is connected to the drill bit part 140, the driving pipe 120 may be inserted to a predetermined depth or greater of the sea bed, and may then reach a target depth, the drill bit part 140 may be disconnected from the driving pipe 120 along with the end of excavation. The driving pipe 120 may be recovered to the through hole 111 of the housing 101 by a device for recovering the driving pipe 120. That is, the pile 110 may be fixed to the sea floor as it is, only the driving pipe 120 may be recovered to the through hole of the housing 101 through the through hole 111 of the pile, and may be lifted with the housing by the crane.

As described above, the drill bit part 140 may be connected to one end of the driving pipe 120. A driving motor may be connected to the other end of the driving pipe 120. That is, as the driving motor rotates the driving pipe 120, the drill bit part 140 connected to one end of the driving pipe 120 may rotate to excavate sea floor. Conventionally, a driving motor is included in a rear part of the drill bit and is also inserted into the sea bed during excavation, but according to the present disclosure, the drill bit part 140 and the driving pipe 120 may be coupled to each other and then the driving motor connected to the driving pipe 120 may be operated, and accordingly, rotation force may be transferred to the drill bit disposed on the front part of the drill bit part 140.

One end of the chain 130 may be fixed to a storage part formed at one side of the pile 110, and the other end of the chain 130 may be input through the through hole 111 formed in the pile 110, may be lowered to the sea floor with the driving pipe 120, and may be inserted into the sea bed. When the driving pipe 120 is recovered after excavation is completed, the chain 130 may be maintained in an empty space of an excavation path and may be used to firmly maintain a fixed state of the pile 110. One end of the chain 130 may be fixed to the pile 110 and the other end thereof may be connected to the drill bit part 140 with the driving pipe 120, and thus the chain 130 may be fixed in the state in which predetermined tension is maintained from a point at which excavation is completed to a point connected to the pile 110. That is, force for pushing the pile 110 at a deep point of the sea bed generated, and thus the fixed state may be maintained.

The drill bit part 140 may include a drill part disposed on the front part of the body. A coupler to which one end of the driving pipe 120 is coupled may be formed on the rear part of the body. A space may be formed in the coupler to allow an end of the driving pipe 120 to be inserted may be formed in the rear part of the drill bit part 140, and a thread may be formed thereon to firmly maintain a coupling state of one end of the driving pipe 120. A thread having a shape engaged with the thread of the coupler may be formed on one end of the driving pipe 120 to be inserted into the coupler. That is, one end of the driving pipe 120 may be coupled to the coupler of the drill bit part 140 while rotating. The driving pipe 120 may rotate using the driving motor as described above. As such, when the driving motor is operated after the driving pipe 120 is coupled to the coupler while rotating, the drill bit part 140 may rotate with the driving pipe 120 to allow the drill bit to excavate the sea floor.

The body of the drill bit part 140 may include a bearing **140*a*. The bearing 140*a* may reduce frictional force generated when the drill bit part 140 coupled to the driving pipe 120 rotates and may prevent the chain from rotating along the drill bit part 140 and being wound around the driving pipe 120, and the chain 130 may be connected to the bearing 140***a*. For example, the other end of the chain 130 may be connected to one side of the bearing 140*a*. In this state, the drill bit part 140 may excavate the sea floor and may drag the driving pipe 120 and the chain 130 into the sea bed.

Through this procedure, when the driving pipe 120 and the chain 130 are inserted into a predetermined depth of the sea bed, the driving motor may be reversely rotated to pull out one end of the driving pipe 120 from the coupler. That is, the driving pipe 120 may be recovered to the through hole 111. In this case, the chain 130 may be maintained in a connected state as it is and may be fixed in place using a body of the drill bit part 140 that completely performs excavation as an anchor.

The drill device according to the present disclosure may further include the swivel 150. The swivel 150 may prevent the chain 130 from being twisted or wound around the driving pipe 120 when the drill bit part 140 rotates. In order to fix the other end of the chain 130, the bearing 140*a* may require a separate fixing member and thus may connect the chain 130 and the bearing 140*a* to each other using the swivel 150. For example, the other end of the chain 130 may be hung and fixed on a body of the swivel 150 and the coupler formed at one side of the bearing 140*a* and the swivel 150 may be coupled to each other to maintain a connected state.

According to an embodiment of the present disclosure, the pile 110 fixed to the sea floor may be provided with at least one and at most a plurality of the drill bit parts 140. One drill bit part 140 may be used when the sea structure is relatively light and a mooring state is sufficiently maintained by one drill bit, and the plurality of drill bit parts 140 may be connected to the pile when the size and weight of the sea structure are large.

When the plurality of drill bit parts 140 are used, the drill bit parts 140 may be radially arranged around the pile 110 to excavate the sea bed. As shown in FIG. 1, an excavation path may be radially spread out, and depending on the excavation path, the drill bit part 140 and the chain 130 that are completely used may be relatively strongly fixed. Accordingly, after the driving pipe 120 is recovered, when buoyancy is generated in the pile 110 due to waves or external force, tension may be generated while the chain 130 inserted into the sea bed is pulled. Force may also be applied to the drill bit part 140 connected to the chain 130, and in this case, the rear part of the body of the drill bit part 140 may be embedded in an inner wall of the excavation path. That is, a part of the coupler, from which the driving pipe 120 escapes, may function as an anchor and may be buried in the inner wall of the sea bed to generate strong fixing force. Accordingly, the pile 110 may be prevented from being lifted upward.

According to an embodiment of the present disclosure, the drill device may also connect the drill bit part 140 directly to the mooring device without using the pile 110. According to an embodiment, the drill device may include the driving pipe 120 connected to a crane installed in a ship for constructing a mooring device and lowered to the sea floor, the chain 130 inserted into the sea floor with the driving pipe, and the drill bit part 140 for excavating the sea floor and inserted into the sea bed in the state in which the driving pipe 120 and the chain 130 are connected. The drill bit part 140 may further include the bearing 140*a* and the swivel 150 in order to prevent the chain 130 from being wound around the driving pipe 120.

When the drill bit part 140 is used without using the pile, at least one and at most a plurality of the drill bit parts may also be basically used, which is the same as the description of FIGS. 1 and 2. That is, when the drill bit part 140 insert the driving pipe 120 and the chain 130 into the sea bed and completely performs excavation, the driving pipe 120 may be recovered and only the drill bit part 140 and the chain 130 may be fixed to the sea bed, which is the same as the description of FIGS. 1 and 2, and the number of the connected drill bit parts 140 may be changed depending on the type of the mooring device.

FIG. 3 is a side view of a drill bit according to an embodiment of the present disclosure. Referring to FIG. 3, the drill bit for excavation may be installed on a front part of the body of the drill bit part 140. As shown in FIG. 3, in order to increase excavation efficiency during rotation, the drill bit part 140 may include a plurality of drill bits 301, 302, and 303. The drill bits 301, 302, and 303 may be arranged at the same interval and may excavate the sea bed while each rotating. As necessary, the drill bit may separately include a motor for rotating each of the plurality of drill bits 301, 302, and 303 separately from rotation of the body of the drill bit part or may include a member with high strength, such as diamond, installed on a surfaces of the drill bits 301, 302, and 303 to brake the sea bed.

FIG. 4 is a side view showing a connection structure of a drill bit part and a driving pipe. Referring to FIG. 4, one end 402 of the driving pipe 120 may be coupled to a coupler 401 formed on a rear part of a body of the drill bit part 140. Because the driving pipe 120 is recovered to the housing after excavation is completed, the state in which the driving pipe 120 is connected to the drill bit part 140 may be maintained when the drill bit part 140 excavates the sea bed, and then when excavation is completed, the drill bit part 140 may remain at a point at which excavation is completed and only the driving pipe 120 may escape from the coupler 401. As described with reference to FIG. 1, the coupler 401 and the end 402 of the driving pipe may be coupled to each other using rotation force of the driving motor and may be decoupled by reversing a rotation direction of the driving motor.

FIG. 5 is a diagram showing the case in which a driving coupled to a drill bit part is recovered. Referring to FIG. 5, when the drill bit part 140 excavates a sea bed 501 to generate an excavation path 502 by a predetermined depth in the state in which the chain 130 and the driving pipe 120 are connected to each other, the driving pipe 120 may be recovered by reversely rotating the driving motor in the ship. The driving pipe 120 may be recovered to the through hole 111 of the housing along the excavation path 502 formed during excavation. The drill bit part 140 and the chain 130 may be fixed to the sea bed as it is.

FIG. 6 is a diagram showing the case in which a drill bit part is fixed to an inner wall of a sea bed. Referring to FIG. 6, after the driving pipe 120 is recovered, the drill bit part 140 and the chain 130 may stand by in the state of buried in the sea bed as it is. Then, when buoyancy is generated in the pile 110, the rear part of the body of the drill bit part may be embedded in and fixed to a predetermined point 601 of the inner wall of the excavation path. That is, the drill bit that completes excavation may function as an anchor for fixing a ship. According to an embodiment of the present disclosure, the sea bed may be excavated using at least one and at most a plurality of the drill bit parts 140 depending on a fixed target, and thus a stable fixed state may be maintained and fixed strength may be firmly maintained.

The drill device according to an embodiment of the present disclosure has been described with reference to the embodiment shown in the drawings to help understanding, but this is merely exemplary, and it will be appreciated by those of ordinary skill in the art that various modifications and equivalents are obtained therefrom and other embodiments are possible. Accordingly, the scope of the present disclosure needs to be defined by the appended claims.

The invention claimed is:

1. A mooring anchor system comprising:

a pile having a body part that is configured to be fixed to a region of a sea floor while the pile is lowered to the sea floor through a mooring construction device installed in a ship and an upper surface of the pile is pressurized in a vertical direction;

a driving pipe that is configured to be lowered to the sea floor via a through hole formed in the pile, wherein a body of the driving pipe is configured to be inserted into a sea bed, and is configured to be recovered through the through hole when excavation is completed;

a chain having one end fixed to one side of the pile and another end of the chain being input through the through hole and is configured to be inserted into the sea bed with the driving pipe; and a drill bit part including a plurality of drill bits installed on a front part of a body of the drill bit part, and configured to insert the driving pipe and the chain into the sea bed in a state in which one end of the driving pipe is coupled to a coupler formed on a rear part of the body of the drill bit part and the another end of the chain being input through the through hole is connected to a bearing surrounding the body of the drill bit part, wherein the drill bit part further includes a swivel connected between one side of the bearing and the another end of the chain such that the chain is prevented from being wound around the driving pipe and a rear part of the body of the drill bit part is configured to be embedded in and fixed to a predetermined point of an inner wall of excavation path when buoyancy is generated in the pile after the driving pipe is recovered.

2. The mooring anchor system according to claim 1, wherein a driving motor is configured to be connected to another end of the driving pipe, and the drill bit part connected to the one end of the driving pipe is configured to rotate to excavate the sea bed as the driving motor rotates the driving pipe.

3. The mooring anchor system according to claim 1, wherein the drill bit part is formed with a plurality of drill bit parts and the plurality of drill bit parts are connected to the pile, and the plurality of drill bit parts are radially arranged around the pile.

* * * * *